US009440326B2

(12) United States Patent
Muncy et al.

(10) Patent No.: US 9,440,326 B2
(45) Date of Patent: Sep. 13, 2016

(54) NON-PLANAR GLASS POLISHING PAD AND METHOD OF MANUFACTURE

(71) Applicant: JH Rhodes Company, Inc., Tempe, AZ (US)

(72) Inventors: Brent Muncy, Clark Mills, NY (US); James Anderson, Albany, NY (US); Scott B. Daskiewich, Oriskany, NY (US); George James Wasilczyk, Allentown, PA (US)

(73) Assignee: JH Rhodes Company, Inc., Tempe, AZ (US)

( * ) Notice: Subject to any disclaimer, the term of this patent is extended or adjusted under 35 U.S.C. 154(b) by 374 days.

(21) Appl. No.: 13/914,384

(22) Filed: Jun. 10, 2013

(65) Prior Publication Data

US 2014/0024296 A1 Jan. 23, 2014

Related U.S. Application Data

(60) Provisional application No. 61/674,760, filed on Jul. 23, 2012.

(51) Int. Cl.
*B24B 37/26* (2012.01)
*B24B 13/02* (2006.01)
(Continued)

(52) U.S. Cl.
CPC ..... *B24B 13/02* (2013.01); *B24B 7/24* (2013.01); *B24B 37/26* (2013.01); *B24D 13/14* (2013.01)

(58) Field of Classification Search
CPC ..... B24B 37/16; B24B 37/22; B24B 37/26; B24B 13/02; B24B 7/24; B24D 11/00; B24D 13/14
USPC ..... 451/41, 285, 287, 290, 527, 529, 533
See application file for complete search history.

(56) References Cited

U.S. PATENT DOCUMENTS 5,558,563 A 9/1996 Cote et al.
6,089,966 A 7/2000 Arai et al.
(Continued)

FOREIGN PATENT DOCUMENTS

CN 1291126 4/2001
CN 1767926 5/2006
(Continued)

OTHER PUBLICATIONS

International Search Report and Written Opinion for PCT/US2013/044949 dated Nov. 8, 2013.
(Continued)

*Primary Examiner* — Eileen Morgan
(74) *Attorney, Agent, or Firm* — Snell & Wilmer, L.L.P.

(57) ABSTRACT

A polishing pad, for polishing of a work piece having portions that are non-planar, the polishing pad comprising a first side and a second side of the polishing pad. The first side is substantially flat, and the second side is configured to polish the non-planar work piece. The polishing pad further comprises a concentric annular channel in the polishing pad, wherein the concentric annular channel comprises a channel surface, wherein the second side of the polishing pad comprises an inner surface, the channel surface, and an outer surface, and wherein the channel surface is recessed relative to the inner surface and outer surface. The polishing pad further comprises a plurality of islands located within the concentric annular channel, wherein the islands comprise an island surface that is raised relative to the channel surface.

21 Claims, 6 Drawing Sheets

(51) Int. Cl.
*B24D 13/14* (2006.01)
*B24B 7/24* (2006.01)

(56) References Cited

U.S. PATENT DOCUMENTS

| | | | | |
|---|---|---|---|---|
| 6,354,929 | B1 | 3/2002 | Adefris et al. | |
| 6,375,559 | B1 | 4/2002 | James et al. | |
| 7,868,957 | B2 * | 1/2011 | Yamazaki | H01L 21/28008 349/43 |
| 2003/0150169 | A1 | 8/2003 | Annen | |
| 2007/0093181 | A1 | 4/2007 | Lugg et al. | |
| 2009/0239456 | A1 * | 9/2009 | Nguyen | B24B 53/017 451/527 |
| 2010/0130112 | A1 | 5/2010 | Bajaj | |
| 2013/0137350 | A1 * | 5/2013 | Allison | B24B 37/16 451/539 |
| 2013/0324020 | A1 * | 12/2013 | Lefevre | B24B 37/205 451/529 |
| 2014/0206268 | A1 * | 7/2014 | Lefevre | B24B 37/22 451/529 |
| 2014/0273777 | A1 * | 9/2014 | Lefevre | B24B 37/26 451/529 |

FOREIGN PATENT DOCUMENTS

| | | | |
|---|---|---|---|
| CN | 101291780 | 10/2008 | |
| JP | 2001001255 | 1/2001 | |
| TW | 380078 | 1/2000 | |
| WO | WO 2014018170 A1 * | 1/2014 | B24B 37/26 |

OTHER PUBLICATIONS

International Preliminary Report on Patentability dated Jan. 27, 2015 in Application No. PCT/US2013/044949.

Office Action dated May 4, 2016 in Chinese Application No. 201380049109.8.

* cited by examiner

NON-PLANAR GLASS POLISHING PAD AND METHOD OF MANUFACTURE

FIELD OF THE INVENTION

The present invention relates to a polishing pad, and more specifically, a polishing pad that has a topography configured to polish a work piece having one or more non-planar portions. The pad may be used in non-planar glass work piece polishing or other non-planar polishing applications such as ceramic or metal work pieces. In an exemplary embodiment, the polishing pad comprises a concentric annular channel wherein non-planar polishing work pieces can be polished on all surfaces.

BACKGROUND OF THE INVENTION

Polishing pads are useful in many applications. One such application is polishing glass work pieces. Regardless of the application, a polishing pad is moved relative to the object (e.g., glass, Si wafer, Sapphire wafer, etc.) being polished. This relative movement may be created by a rotating the polishing pad, by rotating the object being polished, or a combination of such movements. Other linear or any useful relative motion may be used between the polishing pad and the object being polished. In some embodiments, a force may be applied to press the polishing pad in contact with the wafer. The polishing may be performed to varying degrees such as to remove larger imperfections, to achieve a mirror finish and/or final flatness, etc.

Conventionally, the process of polishing glass work pieces to remove lapping imperfections is accomplished by a mechanochemical process in which one or more polishing pads, typically made of urethane, is used with a polishing solution (slurry), commonly comprising fine abrasive particles such as cerium oxide or zirconium oxide. The glass work piece is supported between a platen covered with a polishing pad and a carrier to which the work piece is attached, or, in the case of double-sided polishing, the work piece is held between two platens, each covered with a polishing pad. The pads are typically about 1 mm thick and pressure is applied to the wafer surface. The planar work piece is mechanochemically polished by relative movement between the platen and the work piece. Variations on such polishing systems may also be used to polish a planar work piece.

During polishing, pressure is applied to the planar work piece surfaces by pressing the pad and the work piece together in a polishing tool, whereby a uniform pressure is generated over the entire planar surface owing to the compressive deformation of pads. Polishing tools often have dynamic heads which can be rotated at different rates and at varying axes of rotation. This action removes mass from the work piece and thus the damage from the work piece lapping process.

The polishing pad can, for example, be a polyurethane polishing pad. Typical polyurethane polishing pads are designed to be attached to a planar platen for polishing a planar work piece. However, increasingly, specialty glass work pieces are being used that have non-planar surfaces or that have surfaces comprising non-planar portions. Unfortunately, standard polyurethane polishing pads cannot effectively polish a non-planar work piece. One of the reasons that typical polishing pads are unacceptable for non-planar work pieces is that they do not provide even polishing over the whole surface. Standard polishing pads are generally unable to maintain contact with the entire surface area of the non-planar work piece. Therefore, over certain portions of the work piece's surface, they are unable to remove scratches (relics of the work pieces' lapping process) or other imperfections, in the normal course of polishing a non-planar surface with a planar polishing pad, the polishing pad will not be able to compress enough to effectively contact the entire surface area of the work piece. The use of compressible planar polyurethane foam or a stacked, planar foam composite may help provide additional coverage but still does not contact all surface areas in cases of significant curvature. Work pieces that are not completely polished may wind-up being scrapped as rejected parts.

To counteract these problems, one solution is to increase the force pressing the polishing pad to the non-planar surface to be polished. The increased force is intended to force the polishing pad to conform to the non-planar surface. However, these efforts have proven ineffectual. Either the force is still not enough to uniformly polish the entire surface of the glass to be polished, or the pressure is excessive and causes breakage of the glass. In another attempted solution, typical polishing pads that are planar in nature and of varying degrees of compressibility cannot effectively contact the entire surface area of the work piece to be polished. Also, typical polishing pads that are softer and/or more compressible are of a design that wears out faster, are slow to polish compared to stiffer pads (e.g., a planar surface polyurethane polishing pad), and/or cause defects.

Thus, the industry has turned away from polishing pads for polishing non-planar surfaces, and has widely implemented the use of brushes, flaps, and the like. The brushes or flaps are designed to contact all the surfaces. The flaps may be made of a felt material, a carpet like material, and or the like. The brushes or flaps are designed to polish the non-planar portion of the glass work piece. For example, a rectangular piece of glass may be turned vertically to present a first edge to be polished. The brushes or the flaps may rub over the first edge, to polish that non-planar area. Then the glass can be rotated in its carrier to present a second edge for similar treatment. This process is then repeated for each edge. Although cumbersome, time consuming, expensive, and increasing of the likelihood of damaging the glass, this is the currently preferred process.

One such example process is described now in further detail. A cover glass having both planar and non-planar surfaces is polished using brushes. The cover glass in this example has four sides. The cover glass "blanks" are loaded into "boats" with about 120 pieces to be polished at a time using a customized polishing machine. The cover glass blanks are each oriented in a vertical orientation presenting one of the four sides to the brushes. The non-planar portion of the cover glass blank, near the edge on that side, is polished by the brushes. This polishing takes about 10 to 15 minutes to polish that side of the cover glass for all 120 pieces. Next, the cover glass blanks are rotated 90 degrees to polish a non-planar portion near the edge on a second side of the cover glass. It may take about five minutes to rotate all 120 pieces. After polishing for the second side, the cover glass blanks are rotated again. A non-planar portion near the edge of the third side of the glass is then polished. The cover glass blanks are rotated again, and a non-planar portion near the edge of the fourth side is polished. In one example, the polishing of the non-planar portions of the four sides of the glass takes a total elapsed time of 55 to 75 minutes to complete. The brush life is about four days.

Once all of the non-planar surfaces near the edges of the work piece are polished, then the glass can be placed in a standard 9B polishing machine, in a horizontal carrier, to polish the cover glass' planar portion(s). In one such machine, 12-15 cover glass pieces can be polished at one time. This step may take about 25 minutes for each set of 12-15 pieces.

Some experimentation has also been done in using woolen material and carpet bits as flaps, as an alternative to the brushes. These solutions are similar in costs to the brushes, but are more efficient in polishing (e.g., in 8-10 minutes). These materials have a life of about 6-8 days. Nevertheless, these materials would still involve the use of the five step process described above.

Thus, the use of brushes or flaps to polish non-planar work pieces can be very time consuming. Moreover, use of brushes or flaps can involve five separate polishing steps with intervening set up steps. Each intervening handling step increases the risk of breaking the glass pieces and adds significant amounts of time to the overall process. Moreover the life of the materials is relatively short, so there is an increase in cost and time associated with changing out the polishing medium. For example, the brushes of flaps may need to be replaced every 24 hours due to brushes or flaps becoming disengaged or fatigue that caused the pad to be ineffectual. The brushes or flaps may be "composite pads" for example, polyurethane impregnated felt or synthetic felt pads. Such brushes or flaps are sometimes used, but they can cause surface damage, have a short life, and are expensive compared to polyurethane pads.

Therefore, a need exists for improved systems, methods, and devices for polishing work pieces having surfaces that have non-planar portions.

SUMMARY OF THE INVENTION

In an example embodiment, a polishing pad is provided for polishing of a work piece comprising surface portions that are non-planar. The polishing pad is configured for use with a flat platen of a polishing machine. The polishing pad comprises: a first side and a second side of the polishing pad, wherein the second side is opposite the first side, and wherein the second side is configured to polish the work piece; a concentric annular channel in the polishing pad, wherein the concentric annular channel comprises a channel surface, wherein the second side of the polishing pad comprises an inner surface, the channel surface, and an outer surface, and wherein the channel surface is recessed relative to the inner surface and the outer surface; and a plurality of islands located within the concentric annular channel, wherein each of the plurality of islands comprises an island surface that is raised relative to the channel surface.

In an example embodiment, a method of polishing a surface of a non-planar cover glass with a polishing pad comprises: (a) providing the non-planar cover glass, the non-planar cover glass comprising a non-planar surface; (b) providing a pad comprising: (i) a sublayer, wherein the sublayer comprises a concentric annular channel, wherein the concentric annular channel further comprises islands within the concentric annular channel; and (ii) a polishing layer covering the sublayer, wherein the polishing layer is configured to contact and polish the surface of the non-planar cover glass; and (c) moving the pad relative to the non-planar surface.

In an example embodiment, a method of polishing a non-planar surface of a work piece is provided, wherein the non-planar surface comprises a planar portion and a non-planar portion. The method comprises: (a) affixing a polishing pad to a planar platen, wherein the polishing pad comprises a concentric annular channel that has a radial width that is less than a length of the work piece, and wherein the polishing pad comprises islands in the concentric annular channel; and (b) moving the polishing pad relative to the work piece to polish both the planar portion and the non-planar portion of the non-planar surface of the work piece.

A non-planar work piece polishing pad is provided. The non-planar work piece polishing pad comprises a standard polyurethane polishing pad which is laminated to a soft foam backing that contains a concentric channel. Islands of raised material are also present in the concentric channel. In an exemplary embodiment, a polishing pad is provided for polishing of a work piece having portions that are non-planar. The polishing pad comprises: a first side and a second side, wherein the first side is substantially flat and configured to be attached to a platen for carrying the polishing pad, and wherein the second side is configured to polish the work piece having portions that are non-planar; a concentric annular channel in the polishing pad, wherein the concentric annular channel comprises a channel surface, wherein the first side comprises an inner surface, the channel surface, and an outer surface, and wherein the channel surface is recessed relative to the inner surface and outer surface; and a plurality of islands located within the channel, wherein the islands comprise an island surface that is raised relative to the channel surface.

BRIEF DESCRIPTION OF THE DRAWINGS

The subject matter of the present invention is particularly pointed out and distinctly claimed in the concluding portion of the specification. A more complete understanding of the present invention, however, can be obtained by referring to the detailed description and claims when considered in connection with the drawing figures, wherein like numerals denote like elements, and wherein:

DETAILED DESCRIPTION

Figure 1A:
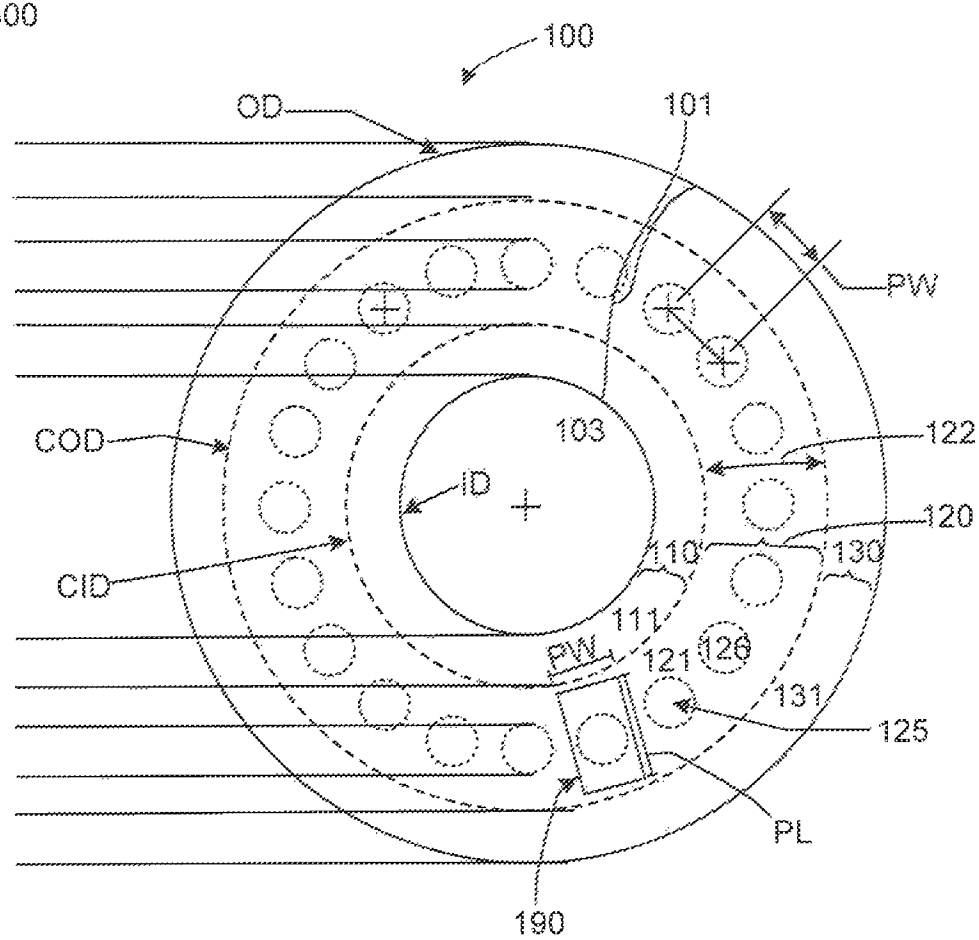
FIG. 1A illustrates a top view of a non-planar work piece polishing pad in accordance with one exemplary embodiment of the present invention.

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

For the sake of brevity, conventional techniques for polishing and polishing pad construction, and/or control of polishing systems, as well as conventional techniques for lamination of polishing pads and cutting or forming polishing pads, may not be described in detail herein. Furthermore, the connecting lines shown in various figures contained herein are intended to represent exemplary functional relationships and/or physical couplings between various elements. It should be noted that many alternative or additional functional relationships or physical connections may be present in a practical polishing system.

In accordance with an example embodiment, and with reference to work pieces having non-planar portions, a new polishing pad is described herein that can maintain its optimal polishing performance longer, relative to prior art polishing pads. The new polishing pad can also more effectively contact the non-planar work piece surface without causing defects, relative to prior art polishing pads. In an example embodiment, the new polishing pad, system and method of its use to polish facilitates more polishing being performed, fewer defects being produced, and thus more products being made in a set period of time. In an example embodiment, a polishing pad has a polyurethane foam pad surface that is shaped to polish non-planar work pieces. In an example embodiment, the system, method and device is configured to achieve high yield by eliminating missed areas of polishing on the corners and edges of the glass work pieces.

In accordance with an exemplary embodiment of the present invention, a polishing pad is disclosed for use in polishing non-planar work pieces. Although described herein as a "work piece," the object to be polished may also be called a "substrate," "glass," "optic," "cover glass," etc. In one example embodiment, the work piece is glass. For example, the work piece may comprise a cover glass for a smart phone. Moreover, the work piece, in other example embodiments, may comprise a silicon semiconductor substrate wafer, sapphire wafers, sapphire crystal, soda-lime glass, Corning® Gorilla® Glass, various commercial grades of glass, ceramics, crystal, and/or the like. Although the object to be polished will frequently be described herein as glass, it should be understood that the object may be suitable material for polishing.

In an example embodiment, the work piece is a cover glass. For example, the cover glass may be used to cover the working surface of an electronic device, in one example embodiment, the work piece is a cover glass for a smart phone. In another example embodiment, the work piece is a cover glass for a tablet, e-book reader, laptop, or other computing device. The cover glass may be for use in a touch screen electronic device, in another example embodiment, the work piece is a watch crystal. In a further example embodiment, the work piece is a chandelier crystal. In another example embodiment, the work piece comprises convex glass lenses for precision optics. Moreover, the work piece can be any suitable object that comprises non-planar portions to be polished.

Figure 3:
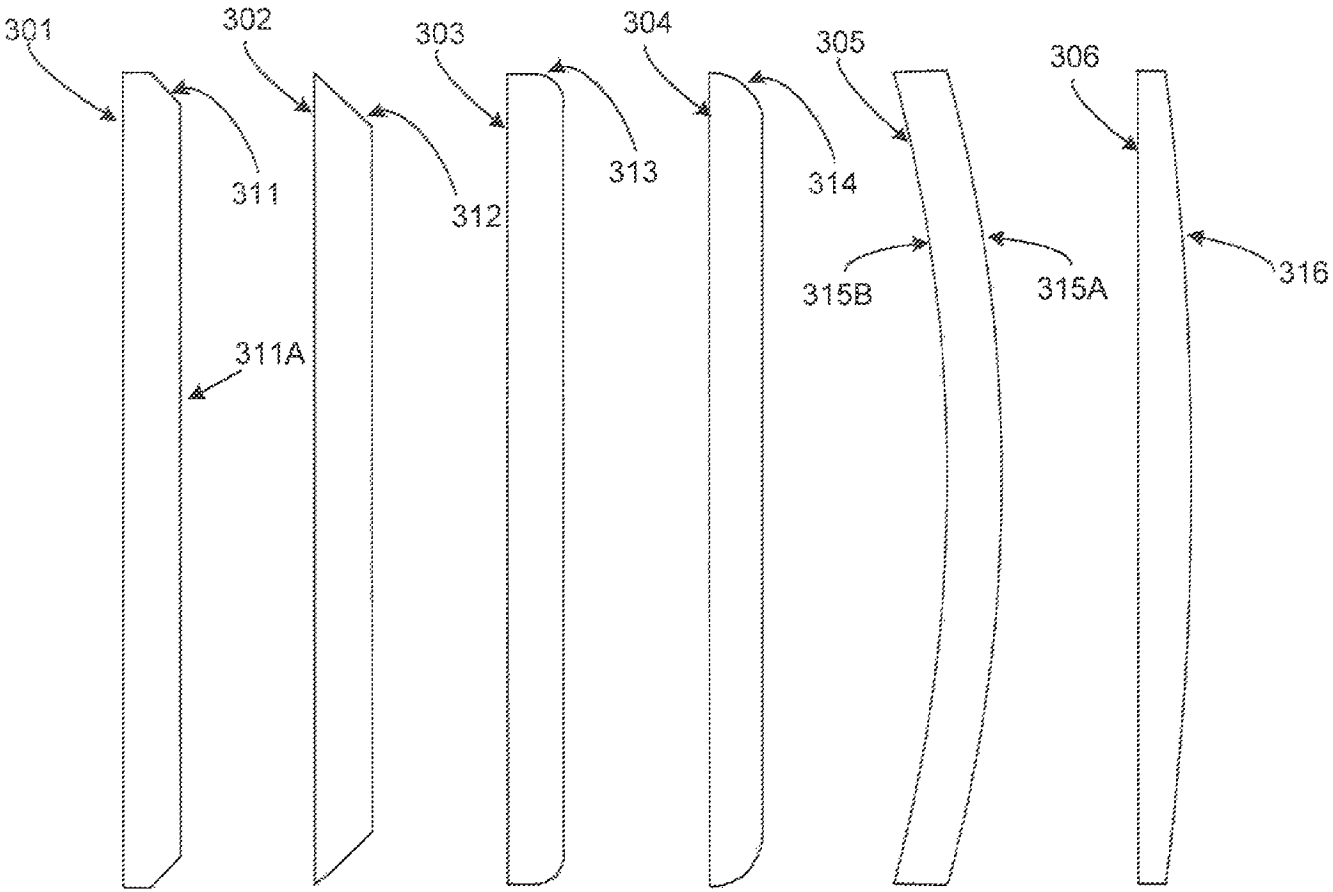
FIG. 3 illustrates various side views of example non-planar glass work pieces.

In the most common application, it is desirable to manufacture mobile phone cover glass having a non-planar surface. Thus, in an example embodiment, and with reference now to FIG. 3, the work piece to be polished comprises a non-planar surface. FIG. 3 illustrates various example non-planar work pieces. Throughout this description, the term non-planar work piece is intended to describe a work piece having at least one surface that comprises at least one portion of that surface that is non-planar. Similarly, the term non-planar surface is intended to mean a surface that comprises at least one portion of that surface that is non-planar. In an example embodiment, a non-planar surface comprises at least one portion of the surface that is planar (a planar portion), e.g., 311A, and at least one portion whose surface is not in the same plane as the surface of the planar portion (a non-planar portion), e.g., 311.

Thus, in an example embodiment, the work piece to be polished may comprise a cover glass (e.g., 301, 302, 303, 304) having a flat portion in the middle of the cover glass (e.g., 311A in work piece 301) and non-planar portions (e.g., 311, 312, 313, 314) near the edges of the cover glass. For example, the area of the cover glass near the edges could have a radius of curvature (e.g., 313, 314), a bevel (e.g., 311, 312), a taper, a parabolic shape (e.g., 314), a rounded shape, and/or the like. Moreover, the edge portion of the surface of the cover glass can comprise any suitable non-planar shape.

A typical flat glass work piece or wafer usually has an edge that is at a 90 degree angle to both surfaces and those surfaces are flat and parallel. In an example embodiment, curved cover glass work pieces may differ in that one or both surfaces have a curvature that is described by one of the following: (1) Edges have a radius of curvature slightly larger than the part height ("PH," see below) that then tapers into a surface that has a radius of curvature much larger than the PH which constitutes a nearly flat surface (the other surface is flat in this case); (2) one surface is flat with 90 degree edges that extend to approximately ½ of the PH where then a radius of curvature similar in size to the PH extends to the other surface where the remaining surface across the work piece has a radius of curvature that is much larger than the PH and is nearly flat; and (3) one surface is flat and the other surface is made entirely of a curved surface (e.g., work piece 306 and entirely curved surface 316) with a radius of curvature much larger than the PH. In each of the above three cases, the work piece could have both sides curved in some combination of the above three examples. For example, work piece 305 has both surfaces 315A, 315B curved over the entire surface of the work piece. The glass work pieces, from a top (face) view could also be round, square, rectangular or some other geometry. In an example embodiment, the work piece may have a non-continuous radius of curvature across an entire surface. Stated another way, the work piece may have no non-planar portions.

In an exemplary embodiment, the polishing pad is physically configured in a manner that the pad can polish non-planar surfaces. Stated another way, the pad can be configured to remove evidence of lapping damage on the non-planar portions as well as on any planar portions of the work piece more effectively, compared to pads that are not so configured.

In accordance with an exemplary embodiment, one side of a polishing pad comprises a channel with islands in the channel. That side of the polishing pad rotates over (moves relative to) a non-planar glass surface. In the example embodiment, the glass is located relative to the polishing pad such that the glass is polished primarily by the portion of the pad comprising the channel and its islands. The polishing pad thus is configured to polish a glass that has a non-planar surface.

Figure 1B:
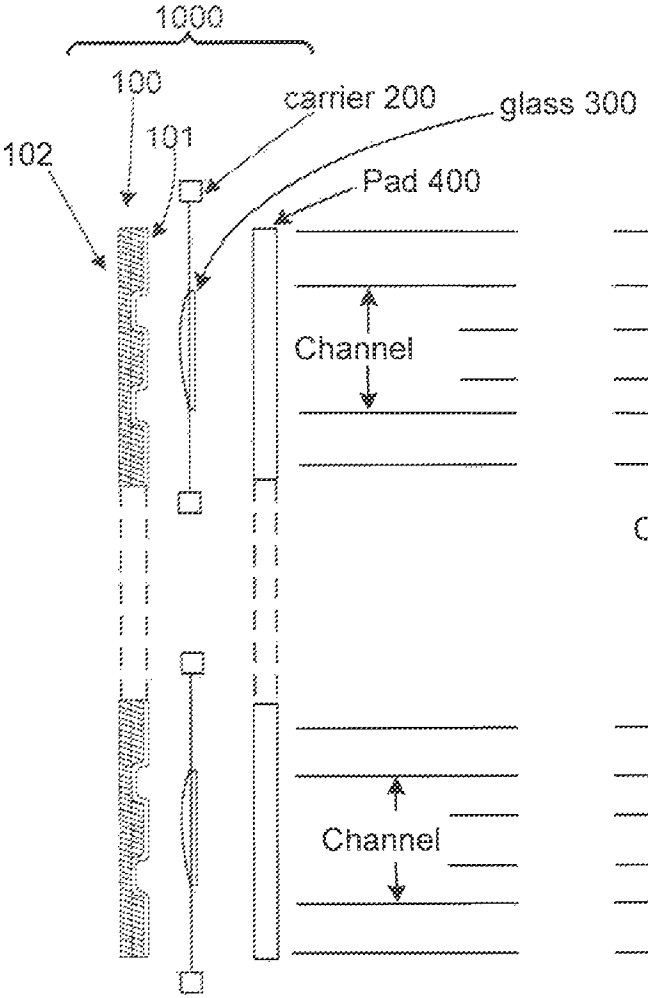
FIGS. 1B, 1C, and 1D illustrate a side cross-sectional view of the non-planar work piece polishing pad in accordance with various exemplary embodiment of the present invention.

With reference now to FIGS. 1A and 1B, an exemplary polishing pad 100 is described. Polishing pad 100 may comprise a circularly shaped polishing pad. In other example embodiments, the pad is shaped other than circularly. Polishing pad 100 may further comprise a first side 101, or top side, and a second side 102, or bottom side. The second side 102 may be a substantially flat side. Second side 102 may be configured to attach to a platen for carrying polishing pad 100. The first side 101 may be configured for polishing a non-planar glass. In various embodiments, polishing pad 100 further comprises a hole 103 in the middle of the pad. In other embodiments, polishing pad 100 has no hole in the middle of the pad when used on a single side polisher.

Pad 100 further comprises a channel 120. In an exemplary embodiment, channel 120 is an annular shaped channel in pad 100. In another exemplary embodiment, channel 120 is a concentric channel formed in the pad. For example, channel 120 may comprise a concentric annular channel formed in a porous microcellular foam sub-layer. Channel 120 does not go all the way through pad 100. Viewed from above the top, polishing surface of pad 100 (i.e., from above first side 101), in an exemplary embodiment channel 120 defines three portions in pad 100: an inner portion 110 located between the center of pad 100 (or the inner diameter of pad 100) and the inner diameter of channel 120; the channel portion defined by channel 120; and an outer portion 130 located between the outside diameter of channel 120 and the outside diameter of pad 100. In an exemplary embodiment, inner portion 110 comprises an inner surface 111, channel 120 comprises a channel surface 121, and outer portion 130 comprises an outer surface 131. The surface of top side 101 comprises the inner surface 111, the channel surface 121, and the outer surface 131. In an example embodiment, although top side 101 is described as having an inner surface 111, channel surface 121, and outer surface 131, the top side and these surfaces are one continuous layer with smooth transitions between the various elevations of these surfaces. This can be achieved, for example, by laminating a polishing layer 180 over base layer(s) with varying surface elevations as described herein.

Channel 120 may be a recessed portion of pad 100. In this exemplary embodiment, channel 120 comprises a channel surface 121 that is recessed relative to other portions of the surface of the top side 101 of pad 100. Thus, pad 100 may comprise channel 120 whose surface 121 is recessed relative to the inner surface 111 and the outer surface 131. In various exemplary embodiments, the inner surface 111 and the outer surface 131 are co-planar. In an example embodiment, the channel surface is the polishing foam portion of the pad design. In an example embodiment this comprises a polyurethane polishing pad that is either grooved or un-grooved. The channel sub-layer, in an example embodiment, is flexible foam that is designed to distribute pressure and conform to the curved edges of the work piece.

In one exemplary embodiment, the depth of channel 120 is equal to the height ("PH") of the part to be polished. For example, surface 121 may be recessed from surfaces 111 and 131 by a distance PH. In one example embodiment, PH is measured at the point of greatest thickness of the glass object before polishing. In another example embodiment, PH is less than or equal to the greatest thickness of the glass, but not less than the greatest minimum finished thickness of the glass. Moreover, PH may be from 0.01 inches to 1 inch, preferably from 0.05 inches to 0.25 inches. Other part heights may also be used. In another exemplary embodiment, the depth of the recess may be variable within channel 120. Various methods for forming channel 120 will be described further herein. Channel 120 may be configured to provide surface contact with non-planar portions of the glass being polished.

In an exemplary embodiment, top side 101 comprises islands 125 located within channel 120. Islands 125 comprise a raised island surface 126 relative to the surface 121 of channel 120. In an exemplary embodiment, island surface 126 is the same height as surfaces 111 and 131. That is to say, in an exemplary embodiment, surfaces 111, 126, and 131 are all co-planar. In other exemplary embodiments, surface 126 is recessed relative to surface 111 and/or 131, but elevated relative to surface 121. In one example embodiment, the islands (whether circular, spokes, or strips as described below) may range in height from 25% to 100% of the channel depth. In an example embodiment, the distance between surface 121 and 126 may be from 0.01 inches to 1 inch, preferably from 0.03 inches to 0.13 inches. The island surface 126 may be configured to polish the curved surface of the glass. The edges of island 125 may be configured to polish the edges of the glass. The height of island 125 may be configured to hold the glass work piece(s) down against bottom pad 400 to prevent the work piece from being dislodged from the carrier. In other words, the islands may be configured to maintain sufficient pressure on the work piece(s) to keep it from being swept out of the carrier for the work piece.

Although any suitable dimensions and relative dimensions may be used to form pad 100, the dimensions and relative dimensions of an exemplary polishing pad may be described herein. In one exemplary embodiment, channel 120 the diameter of the center of pad 100 is centered in the pad. Stated another way, the diameter of the center of the annular channel 120 is located half way between (mid-point of the outer diameter ("OD") of pad 100 ("ODpad") and the inner diameter ("ID") of pad 100 ("IDpad"). i.e., the diameter of the center of channel 120 is equal to 0.5*(ODpad+IDpad). Moreover, the radial width 122 of channel 120 may be related to the part length ("PL") of the glass part 190 to be polished. For clarity, the part length is one dimension of the work piece, such as, for example, the long dimension of the cover glass. In an example embodiment, the channel is slightly smaller than the PL of the work piece. For example, the OD of channel 120 ("COD") may be equal to 0.5*[ODpad+IDpad+(PL*0.95)]. Similarly, the ID of channel 120 ("CID") may be equal to 0.5*[ODpad+IDpad−(PL*0.95)]. The factor (0.95) used in the foregoing equations is merely exemplary, and any suitable factors (e.g., Y and Z, whose values may for example be greater than 0.5 and less than 1) may be used to cause the channel to be sized for suitable polishing of the work piece. In an example embodiment, the channel width is approximately the same width as the part to be polished. In other words, the channel width is plus or minus 10% of the length of the work piece to be polished (the length corresponding to the radial length of the work piece when oriented within the channel for polishing). Furthermore, any diameter for the channel center, COD and/or CID, about the center of pad 100, may suitably be used.

In accordance with a further exemplary embodiment, islands 125 may be located about the center of pad 100, within channel 120. That said, in other exemplary embodiments, islands 125 are not centered within channel 120. In an exemplary embodiment, islands 125 may each be centered on the radial center of channel 120. Each island may be spaced apart from its neighboring island by an on-center distance equal to the part width ("PW") of the glass to be polished. In an exemplary embodiment, the PW may be from 1 inch to 20 inches, preferably from 2 inches to 12 inches, and more preferably from 2 inches to 3 inches. Moreover, any suitable PW may be used. Moreover, islands 125 may be spaced apart by more or less than the PW distance. In addition, the islands may be spaced apart by different amounts around the circular pad 100. Each island may further comprise a diameter of 0.8*PW. Nevertheless, the islands may comprise diameters smaller or larger than 0.8*PW. In an exemplary embodiment, the islands comprise a diameter of approximately 0.8 inches to 16 inches. Moreover, although islands 125 are described herein as circular in shape, islands 125 may be rectangular, triangular, octagonal, or any other suitable shape.

Although described herein as circular type islands, in other example embodiments, islands 125 may be more like spokes in a wheel. For example, the spokes may extend in a radial direction. The spokes may extend from the channel inner diameter to the channel outer diameter in a radial direction. The spokes may connect to the channel ID and/or OD, or may be separated from the channel ID and/or OD. In an example embodiment, the spokes have a width in the rotational direction of approximately 0.8*PW, though any suitable spoke width may be used. In other example embodiments, the number of spokes may be increased as the spoke width is decreased.

In another example embodiment, channel 120 comprises radially long "islands." In this example embodiment, the "island" may be wider (in the circumferential direction) than it is tall (radial direction). In the extreme limit of this example, the "island" may comprise a belt, strip, or annulus within the channel. Thus, in this example embodiment, the "island" may comprise a solid strip around the center of the pad and located in approximately the middle of the channel. In other embodiments, the annulus is broken up by one or more breaks in the annulus. Although various types, shapes and sizes of "islands" may be used, in an example embodiment, the pad comprises a channel that is approximately PW tall in the radial direction and that comprises one or more islands within the channel that are configured to retain the part being polished within the channel.

In accordance with a further exemplary embodiment, a polishing system 1000 comprises a polishing pad 100 that is configured to polish non-planar surfaces, a carrier 200, the object (e.g. glass) to be polished 300, and a conventional polishing pad 400 that is configured to polish flat surfaces. Polishing system 1000 is configured to polish the curved surface of the glass 300 with pad 100 and the flat surface of glass 300 with pad 400.

In various example embodiments, polishing pad 100 can be a microporous foam polishing pad. In other example embodiments, polishing pad 100 may be an embossed pad. For example, the pattern of channels and islands may be achieved by pressing a die with the desired design onto a polishing pad using the appropriate combination of heat, pressure, depth of penetration and dwell time to effect the design. In another example embodiment, polishing pad 100 may be made by thermo forming a pad. In another example embodiment, polishing pad 100 is made by injection molding the microcellular foam sublayer with its channel and islands, and then laminating a polishing foam layer over the microcellular foam sublayer. In yet another example embodiment, a channel and islands can be carved in a microporous foam polishing pad with, for example, a router. In an example embodiment, the router could be robotically driven to carve a channel with islands in the surface of the microcellular foam pad. The channeled and islanded foam polishing pad could then be laminated with a polishing foam layer over the whole pad surface (channel, islands, and rest of the surface of the pad). Moreover, any suitable polishing pad comprising a channel and islands may be used to polish a non-planar work piece.

In various exemplary embodiments, polishing pad 100 may be formed by laminating die cut concentric microcellular foam pads (181 and 182) to build up the pad with its channel and islands. Moreover, the pad may comprise various materials.

In accordance with another exemplary embodiment, polishing pad 100 may comprise a polishing layer 180, also described herein as a "sheet," laminated onto a microcellular foam matrix that has a channel. In an exemplary embodiment, the polishing pad also comprises circular formations, islands, within the center of the channel. In accordance with an exemplary embodiment, polishing pad 100 comprises base layers 181 and 182 base 181 and base 182) and a polishing layer 180. In an example embodiment, polishing layer 180 is a foam polishing layer, in an example embodiment, foam polishing layer 180 is a polyurethane foam polishing layer. In an example embodiment, base layer(s) 181 and/or 182 are micro cellular foam layers. Base 181 is laminated on top of base 182, and foam polishing layer for sheet) 180 is laminated on top of base 181. In an exemplary embodiment, base 181 has a height of B1, base 182 has a height of B2, and foam polishing layer for cushion layer) 180 has a height of A. In an exemplary embodiment, B1 may be from 0.01 to 1 inches, B2 may be from 0 to 0.15 inches, and A may be from 0.01 to 0.25 inches. B1 and B2 could be the same heights, in one example embodiment. In other example embodiments, B1 and B2 are of different heights (thicknesses). Other suitable heights may be used. In one example embodiment, base 181 and 182 are made of the same materials. In another example embodiment, base 181 and 182 are made of different materials. In further example embodiments, polishing layer 180 can comprise the same material as one or both of base 181 and 182. Moreover, although described herein as being made of microcellular foam, base 181 and 182 can be a soft polyurethane open cast foam, or other suitable material. In an example embodiment, layer 180 overlays the surface of base 181 and exposed portions of base 182.

Although described herein as a polyurethane foam polishing layer and porous microcellular foam base layer(s), it should be understood that any suitable cellular foamed pad types may be used, and this description is not limited to particular polymer formulations.

In an exemplary embodiment, the polyurethane foam polishing layer is formed by mixing a polyurethane prepolymer, a curing agent, a surfactant, and a foaming agent. In some embodiments, an abrasive filler may also be mixed with the other ingredients. The components may be mixed together using any of the industry standard mixing techniques such as high shear blending, high speed, generally low shear mixing basket blending, or high pressure impingement mixing. A foam bun may be formed, for example, in an open mold, a floating lid closed mold, or a vented closed mold. The foam bun may be cured and then sliced into sheets. Moreover, in another exemplary embodiment, the standard polyurethane pad has a bulk density of 0.3 to 0.9 g/cm^3 and a hardness of 50 to 95 ASTM D2240 Shore A. In one example embodiment, both the polishing layer 180 and the base layer (e.g. 181) have a bulk density of 0.3 to 0.9 g/cm^3 and a hardness of 50 to 95 ASTM D2240 Shore A.

Polishing layer (sheet) 180 can be constructed from a variety of materials. For example, in an exemplary embodiment, foam polishing layer 180 can be polyurethane, polyurea, polyimine, polyisocyanurate, polyepoxide, polyethylene, polystyrene, polyvinyl chloride, acryl foam or a mixture thereof. These polymer foams can be produced by mixing a polymerizing agent, typically an isocyanate-terminated monomer, and a prepolymer, typically an isocyanate functional polyol or a polyol-diol mixture.

Classes of polymerizing agents, isocyanate-terminated monomers, that may be used to prepare the particulate crosslinked polyurethane include, but are not limited to, aliphatic polyisocyanates; ethylenically unsaturated polyisocyanates; alicyclic polyisocyanates; aromatic polyisocyanates wherein the isocyanate groups are not bonded directly to the aromatic ring, e.g., xylene diisocyanate; aromatic polyisocyanates wherein the isocyanate groups are bonded directly to the aromatic ring, e.g., benzene diisocyanate; halogenated, alkylated, alkoxylated, nitrated, carbodiimide modified, urea modified and biuret modified derivatives of polyisocyanates belonging to these classes; and dimerized and trimerized products of polyisocyanates belonging to these classes.

Examples of aliphatic polyisocyanates from which the isocyanate functional reactant may be selected include, but are not limited to, ethylene diisocyanate, trimethylene diisocyanate, tetramethylene diisocyanate, hexamethylene diisocyanate (HDI), octamethylene diisocyanate, nonamethylene diisocyanate, dimethylpentane diisocyanate, trimethylhexane diisocyanate, decamethylene diisocyanate, trimethylhexamethylene diisocyanate, undecanctriisocyanate, hexamethylene triisocyanate, diisocyanato-(isocyanatomethyl)octane, trimethyl-diisocyanato (isocyanatomethyl)octane, bis(isocyanatoethyl) carbonate, bis (isocyanatoethyl)ether, isocyanatopropyl-diisocyanatohexanoate, lysinediisocyanate methyl ester and lysinetriisocyanate methyl ester.

Examples of ethylenically unsaturated polyisocyanates from which the isocyanate functional reactant may be selected include, but are not limited to, butene diisocyanate and butadiene diisocyanate. Alicyclic polyisocyanates from which the isocyanate functional reactant may be selected include, but are not limited to, isophorone diisocyanate (IPDI), cyclohexane diisocyanate, methyleyclohexane diisocyanate, bis(isocyanatomethyl)cyclohexane, bis(isocyanatocyclohexyl) methane, bis(isocyanatocyclohexyl) propane, bis(isocyanatocyclohexyl)ethane, and isocyanatomethyl-(isocyanatopropyl)-isocyanatomethyl bicycloheptane.

Examples of aromatic polyisocyanates wherein the isocyanate groups are not bonded directly to the aromatic ring from which the isocyanate functional reactant may be selected include, but are not limited to, bis(isocyanatoethyl) benzene, tetramethylxylene diisocyanate, bis(isocyanatomethylethyl) benzene, bis(isocyanatobutyl) benzene, bis(isocyanatomethyl) naphthalene, bis(isocyanatomethyl)diphenyl ether, bis(isocyanatoethyl)phthalate, mesitylene triisocyanate and di(isoeyanatomethyl) furan. Aromatic polyisocyanates, having isocyanate groups bonded directly to the aromatic ring, from which the isocyanate functional reactant may be selected include, but are not limited to, phenylene diisocyanate, ethylphenylene diisocyanate, isopropylphenylene diisocyanate, dimethylphenylene diisocyanate, diethylphenylene diisocyanate, diisopropylphenylene diisocyanate, trimethylbenzene triisocyanate, benzene triisocyanate, naphthalene diisocyanate, methylnaphthalene diisocyanate, biphenyl diisocyanate, ortho-tolidine, diisocyanate, diphenylmethane diisocyanate, bis(methyl-isocyanatophenyl) methane, bis(isocyanatophenyl) ethylene, dimethoxy-bipheny-dlisocyanate, triphenylmethane triisocyanate, polymeric diphenylmethane diisocyanate, naphthalene triisocyanate, diphenylmethane-triisocyanate, methyl-diphenylmethane pentaisocyanate, diphenylether diisocyanate, bis(isocyanatophenylether) ethyleneglycol, bis (isocyanatophenylether) propyleneglycol, benzophenone diisocyanate, carbazole diisocyanate, ethylcarbazole diisocyanate and dichlorocarbazole diisocyanate.

Examples of polyisocyanate monomers having two isocyanate groups include, xylene diisocyanate, tetramethylxylene diisocyanate, isophorone diisocyanate, bis(isocyanatocyclohexyl)methane, toluene diisocyanate (TDI), diphenylmethane diisocyanate (MDI), and mixtures thereof.

Commonly used prepolymers, isocyanate functional polyols, include, but not limited to, polyether polyols, polycarbonate polyols, polyester polyols and polycaprolactone polyols. Commercial prepolymers, such as Adiprene® L213 a TDI, terminated polyether based (PTMEG), are readily available.

Further, the molecular weight of the polyols can vary widely, for example, having a number average molecular (Mn) of from 500 to 15,000, or from 500 to 5000, as determined by gel permeation chromatography (GPC) using polystyrene standards.

Classes of polyols that may be used to prepare the isocyanate functional prepolymers of the first component of the two-component composition used to prepare the particulate crosslinked polyurethane include, but are not limited to: straight or branched chain alkane polyols, e.g., ethanediol, propanediol, propanediol, butanediol, butanediol, glycerol, neopentyl glycol, trimethylolethane, trimethylolpropane, ditrimethylolpropane, erythritol, pentaerythritol and di-pentaerythritol; polyalkylene glycols, e.g., di-, tri- and tetraethylene glycol, and di-, tri- and tetrapropylene glycol; cyclic alkane polyols, e.g., cyclopentanediol, cyclohexanediol, cyclohexanetriol, cyclohexanedimethanol, hydroxypropylcyclohexanol and cyclohexanediethanol; aromatic polyols, e.g., dihydroxybenzene, benzenetriol, hydroxybenzyl alcohol and dihydroxytoluene; bisphenols, e.g., isopropylidenediphenol; oxybisphenol, dihydroxybenzophenone, thiobisphenol, phenolphthlalein, bis(hydroxyphenyl)methane, (ethenediyl)bisphenol and sulfonylbisphenol; halogenated bisphenols, e.g., isopropylidenebis(dibromophenol), isopropylidenebis(dichlorophenol) and isopropylidenebis(tetrachlorophenol); alkoxylated bisphenols, e.g., alkoxylated isopropylidenediphenol having from 1 to 70 alkoxy groups, for example, ethoxy, propoxy, and butoxy groups; and biscyclohexanols, which can be prepared by hydrogenating the corresponding bisphenols, e.g., isopropylidene-biscyclohexanol, oxybiscyclohexanol, thiobiscyclohexanol and bis (hydroxycyclohexanol)methane. Additional classes of polyols that may be used to prepare isocyanate functional polyurethane prepolymers, include for example, higher polyalkylene glycols, such as polyethylene glycols having number average molecular weights (Mn) of, for example, from 200 to 2000; and hydroxy functional polyesters, such as those formed from the reaction of diols, such as butane diol, and diacids or diesters, e.g., adipic acid or diethyl adipate, and having an Mn of, for example, from 200 to 2000. In an embodiment of the present invention, the isocyanate functional polyurethane prepolymer is prepared from a diisocyanate, e.g., toluene diisocyanate, and a polyalkylene glycol, poly(tetrahydrofuran) with an $M_n$ of 1000.

Additionally, the isocyanate functional polyurethane prepolymer may optionally be prepared in the presence of a catalyst. Classes of suitable catalysts include, but are not limited to, tertiary amines, such as triethlamine, triethylene diamine, and dimethylcyclohexylamine, organometallic compounds, such as dibutyltin dilaurate, potassium octoate, bismuth octoate, bismuth neodecanoate, zinc neodecanoate, aminomethylacrylic salts, and potassium acetate, and low emission or non-fugitive amine catalysts that typically include an isocyanate reactive moiety as part of their molecular structure.

In some exemplary embodiments, an abrasive filler may also form part of foam polishing layer (sheet) 180. This abrasive filler may include exemplary abrading particles that include, but are not limited to particles of, for example, cerium oxides, silicon oxides, aluminum oxides, zirconia, iron oxides, manganese dioxides, kaolin clays, montmorillonite clays, and titanium oxides. Additionally, exemplary abrading particles may include, but are not limited to silicon carbides and diamond.

Preferably, it is possible to manufacture urethane polymers for polishing pads with a single mixing step that avoids the use of isocyanate-terminated monomers. A prepolymer is mixed in an open-air container with the use of a high shear impeller. During the mixing process, atmospheric air is entrained in the mix by the action of the impeller, which pulls air into the vortex created by the rotation. The entrained gas bubbles act as nucleation sites for the subsequent foaming process. In other example embodiments, other sources of nucleation sites include air entrained with the filler, air in the components such as the prepolymer, and injection air. A blowing agent, such as water, is then added to the mix to create the reaction which produces the $CO_2$ gas responsible for cell growth. During this open-air mix and while in the liquid phase, other optional additives can be added to the mix such as surfactants or additional blowing agents. The abrasive filler particles are added and mixed in during this liquid phase. Finally, the prepolymer is reacted with a foaming agent such as, 4,4'-methylene-bis-o-chloroaniline [MBCA or MOCA]. The MOCA initiates polymerization and chain extension, causing the viscosity of the mix to increase rapidly. There is a short time window after the addition of MOCA of about 1-2 minutes during which the viscosity of the mix remains low, called the "low-viscosity window." The mix is poured into the mold during this window. Quickly after the pour, the window passes, and existing pores become effectively frozen in place. Although pore motion has essentially ended, pore growth continues, as $CO_2$ continues to be produced from the polymerization reaction. The molds then oven cure to complete the polymerization reaction, typically 6-12 hours at 115 C.

After oven curing, the molds are removed from the oven, and allowed to cool. The slices can be made into circular pads by cutting them to shape with a punch or cutting tool, after which an adhesive is usually applied to one side of the pad. The pad surface can then be grooved, if desired, on the polishing surface in a pattern such as a cross-hatched pattern (or any other suitable pattern). At that point, the pads are generally ready for lamination to microcellular foam layers 181 and 182.

Also, in an exemplary embodiment of the present invention, the geometry or shape of grooves may comprise at least one of a square trough, a rounded trough, and a triangular trough. In addition to the specific embodiments disclosed, numerous physical configurations of various geometries to the polishing pad surface are contemplated in this disclosure.

In addition to the exemplary pad surface configurations, methods for forming these pads are herein disclosed. In an exemplary embodiment of the present invention, grooves can be created via any mechanical method capable of producing grooves in a polymer foamed polishing pad. In an exemplary embodiment of the present invention, grooves can be created with a circular saw blade, punch, a needle, a drill, a laser, an air jet a water jet, or any other instrument capable of rendering grooves in the pad. Moreover, grooves can be made simultaneously with a multiple gang-saw jig, a multiple-drill bit jig, a multiple punch jig, or a multiple-needle jig. Thus, any suitable groove pattern may over-lay the macro pad-with-channel form described herein.

Figure 1C:
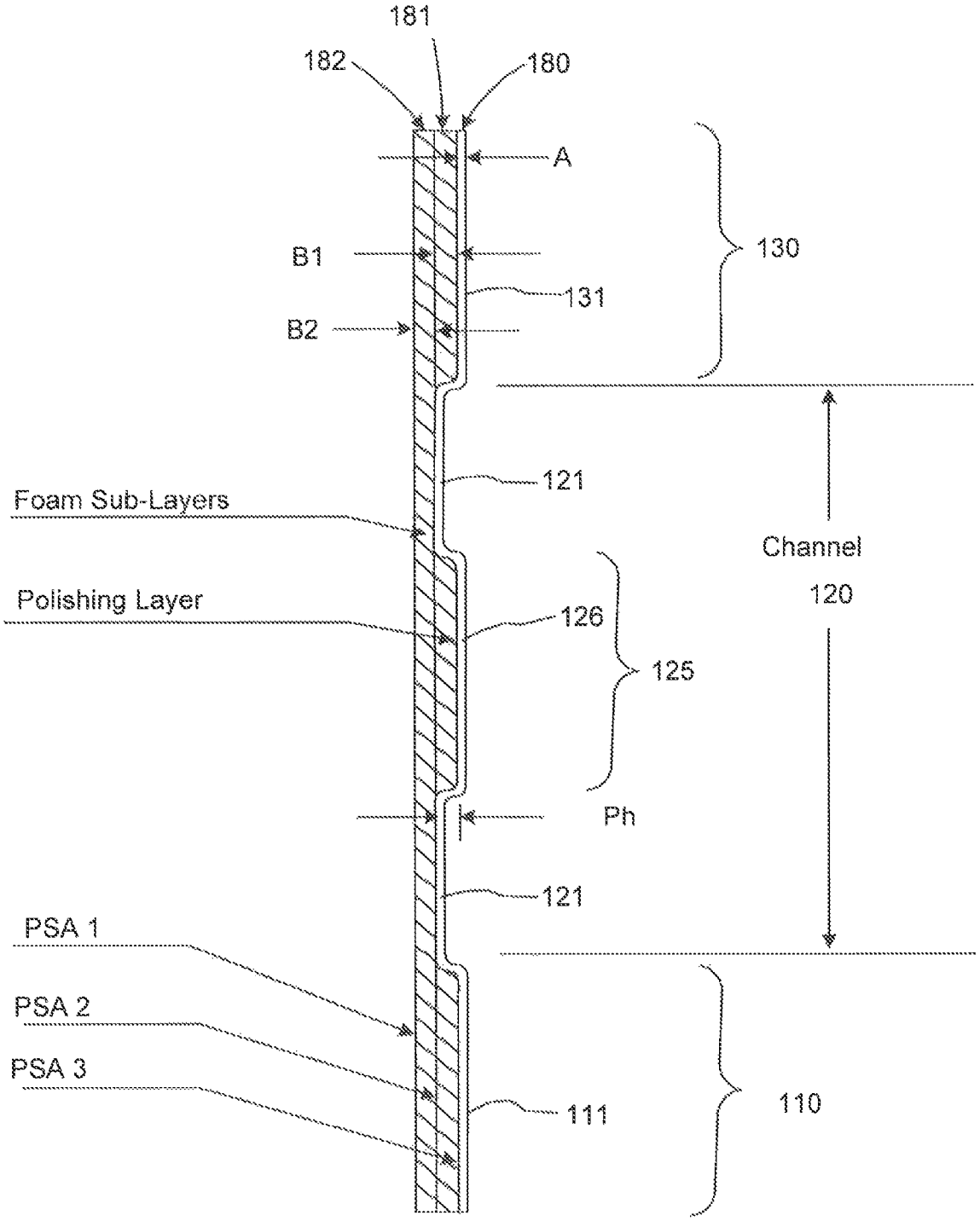
Figure 1D:
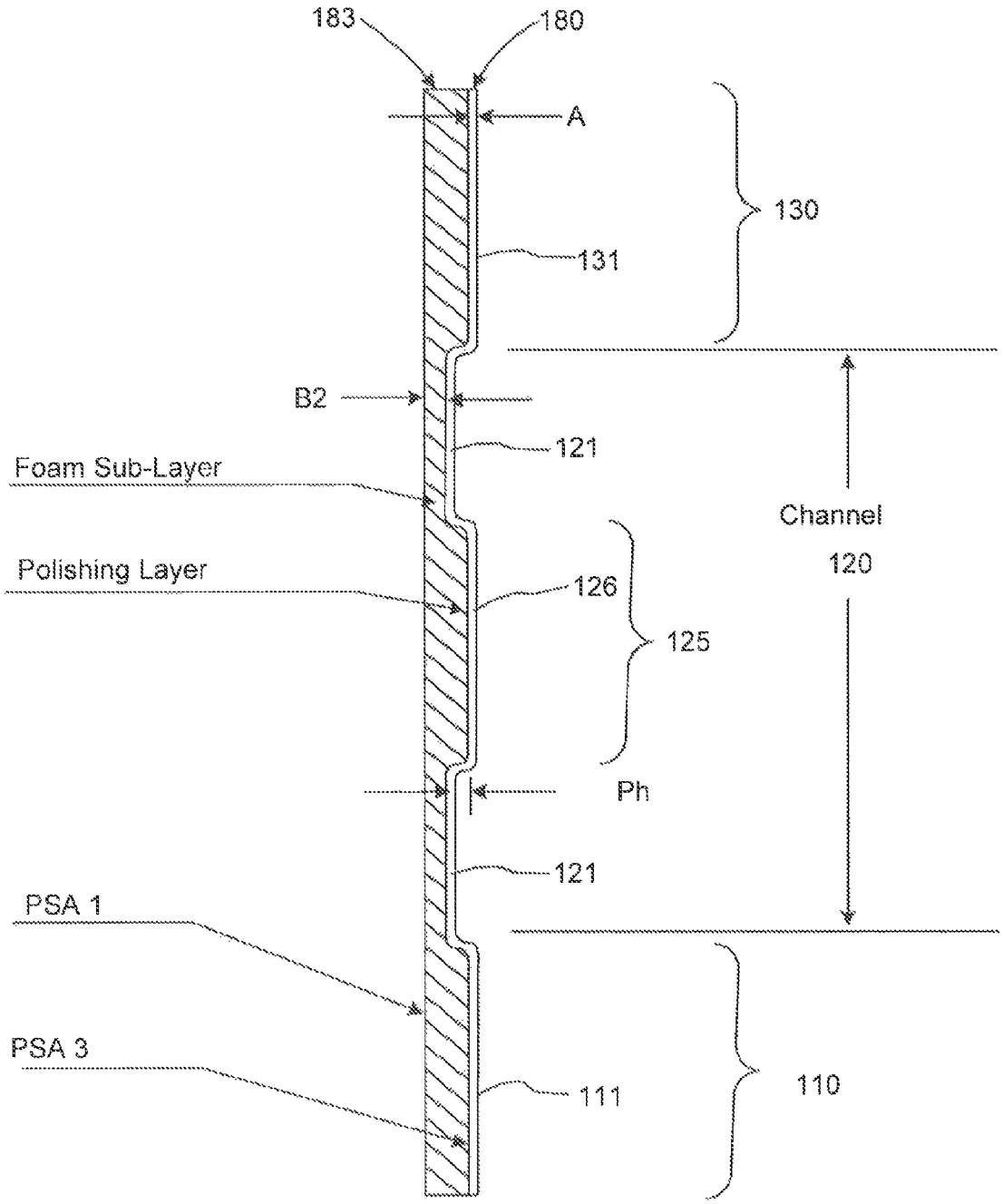

In one example embodiment, and with reference to FIGS. 1C and 1D, the polishing pad comprises a base layer 183 (or sub-layer) and a polishing layer 180. The base layer can be a single layer, two layers (e.g., layers 181 and 182), or multiple layers. The base layer(s) can comprise a foam material. In other words, the base layer can be a foam layer. In this example embodiment, the foam layer can comprise a microcellular foam layer, a nonporous microcellular foam layer, a syntactic foam layer, and/or other suitable foam layers. The polishing layer, in an example embodiment can comprise a foam polishing layer. In another example embodiment, the polishing layer can comprise a polyurethane foam polishing layer, a felt pad, a composite pad such as a polyurethane impregnated non-woven polyester pad, and/or other suitable polishing layers.

In an example embodiment, the foam sub-layer(s), e.g., microcellular foam layers 181 and 182, comprise of polyethylene, polypropylene, or polyurethane microcellular foam, and/or the like. In an example embodiment, the base layer(s) (or sub-layer(s)) 181 and 182 may comprise a bulk density of 0.005 to 0.5 g/cm^3 (or more preferably from 0.005 to 0.015 g/cm^3) and a hardness of 5 to 40 ASTM 12240 Shore A. In an example embodiment, microcellular foam layers 181 and 182 are supplied as brand name GTW-492 by Adchem Corporation, Riverhead N.Y., USA pre-laminated on both surfaces with polyacrylic PSA.

In an exemplary embodiment, PSA layers 1, 2, and 3 comprise polyacrylic double sided tape adhesive. PSA can also comprise synthetic rubber or polyurethane double sided adhesive.

Figure 2:
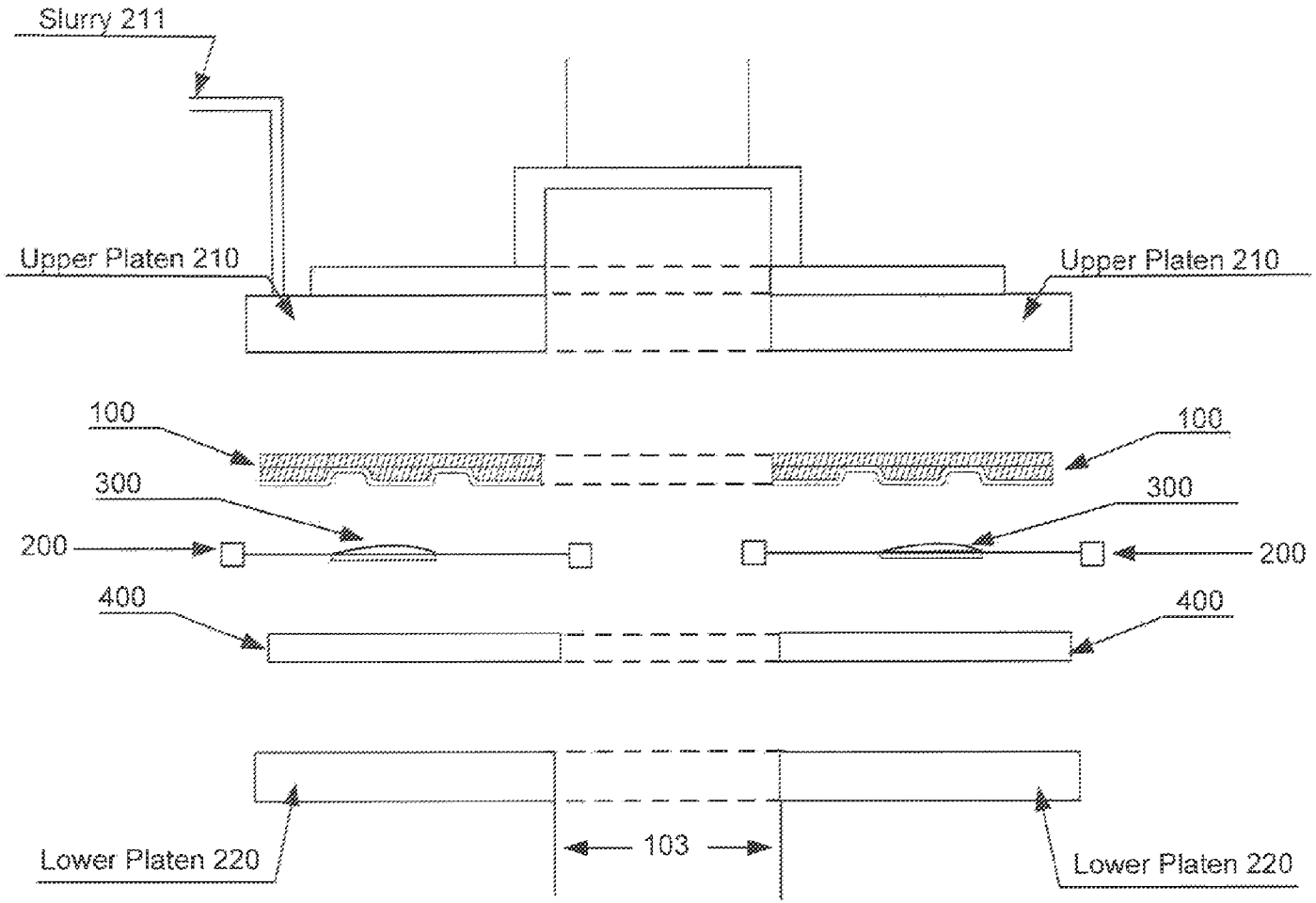
FIG. 2 illustrates a side cross-sectional view of a polishing table in accordance with one exemplary embodiment of the present invention.

With reference to FIG. 2, in one exemplary embodiment, the polishing pad 100 may be used in connection with a polishing table, a slurry, and a platen. In an example embodiment, the platen is planar. In an example embodiment, planar means that the platen is substantially flat. Although any suitable standard for flatness may be used, in one example embodiment, the tolerance of platen flatness is less than 0.00118" (30 μm). Stated another way, in an example embodiment, the platen is not shaped to conform to the shape of the non-planar device to be polished. A carrier 200 is configured for holding the object to be polished (e.g. object 300). Pad 100 may be moved relative to the object 300 being polished. The object 300 is sandwiched between pad 100 and pad 400. Pad 100 may be attached to an upper platen 210 on a first side of pad 100, wherein a second side of pad 100 is configured to polish against the object 300. Again, in an example embodiment, upper platen 210 comprises a flat surface that is adhered to the first side of pad 100. Pad 400 may be attached to a lower platen 220 on a first side of pad 400, wherein a second side of pad 400 is configured to polish against the object 300. Slurry may be added, for example via a slurry input 211 associated with upper platen 210. However, other methods of adding and using slurry for polishing may be used. During the polishing process, the pad will conform to the surface of a non-planar part better than a traditionally designed planar pad or stack of planar pads.

In an exemplary embodiment, the microcellular foam layer 181 is die cut into concentric rings and laminated onto base layer 182 in the configuration shown in FIG. 1B. In one example embodiment, polishing layer 180 may then be laminated onto the exposed adhesive from microcellular foam layers 181 and 182 and forced to form the channel created by the missing portions of microcellular foam layer 181.

In another example embodiment, circular pieces of microcellular foam layer 181 are die cut and laminated in the pattern seen in FIG. 1A. The circular pieces may be laminated at an interval equal to the Part Width (PW). The interval may be greater or less than the part width PW. In this example embodiment, polishing layer 180 is then laminated over these pieces and is formed around them such that bumps are created in the channel. In an exemplary embodiment, the carrier 200 comprises a hole for receiving the work piece to be polished. The edge of the hole in carrier 200 drives against the edge of the glass. In an example embodiment, the raised portions (i.e., inner portion 110, outer portion 130, and island 125) are configured to hold the carrier down.

In another example embodiment, the topography of the polishing pad disclosed herein can be formed by thermal embossing in at least two ways. One way is to place the entire pad with a planar layer of flexible microcellular loam laminated to a foam polishing layer on a flat mold. A heated top mold piece is then compressed into the pad at a temperature, pressure, and time such that the desired topography is permanently set into the pad. In other words, the top mold piece is configured to create the channel and islands, described herein, when pressed into the pad. Another way to emboss the pad is to emboss the topography of the pad (e.g., channel and islands) into the microcellular foam layer only and then laminate the polishing foam layer onto the microcellular layer.

In contrast to prior art polishing methods, the present disclosure provides a system, methods and devices that facilitate faster, less expensive, lower reject rate, lower breakage, and more effective polishing of non-planar work pieces. In particular, the pad disclosed facilitates a polishing process that comprises fewer steps than used to currently polish non-planar work pieces. For example, in an example embodiment a single polishing step is used to polish a non-planar work piece having N sides (where N is greater than 2, and often N=4). In contrast, prior art polishing processes involved multiple steps, e.g., N+1 polishing steps and intermediate setup steps to polish an N sided non-planar work piece. The single polishing step may comprise the process of loading a work piece into a carrier in a polishing machine comprising a flat platen having attached thereto a polishing pad, the polishing pad comprising a channel in a polishing surface of the polishing pad, and comprising at least one island in the channel, and polishing all portions of the surface of the work piece (the surface of the work piece facing the polishing pad, that is).

In some example embodiments, the polishing may be performed in two or more steps for the purpose of using pads of different polishing qualities. For example, in the primary polish step a relatively coarse abrasive pad may be used, and in the final polish step a relatively less abrasive pad may be used (relative to each other). The primary polish step removes gross imperfections on the surface of the work piece while achieving the desired form. The final polish may be configured to produce a specular finish with a specified roughness. In this two pad example, in accordance with an example embodiment, only two polishing steps are used to polish the work piece regardless of the number of sides it has. In contrast, however, typical polishing of a four sided work piece would take at least six polishing steps (4 brushes+2 different pads), and more likely eight steps (4 brushes+1 pad+4 different brushes+1 different pad). In the general case, in an example embodiment using the principles disclosed herein, the total number of polishing steps is X, in the case of an N sided non-planar work piece that is to be polished with X different polishing pads, in an example embodiment, a first pad may have a layer 101 of a first abrasive quality, and the second pad may have a layer 101 of a different abrasive quality. Moreover, any two different pads, configured for non-planar work piece polishing, may be used. In contrast, however, in the prior art polishing, the number of polishing steps is X*(N+1) or at least N+X for an N sided non-planar work piece. Thus considerable time can be saved relative to prior art polishing, particularly when multiple polishing steps are involved by using the pad of the present disclosure.

It is emphasized that while some embodiments disclosed herein contemplate polishing two sides of the glass work piece, other embodiments contemplate use of a single polishing pad and only polishing one side, the side exposed to the polishing pad. Thus, where it is discussed herein about polishing all of the work piece, it should be noted that this may mean all of the work piece that faces the polishing pad, including non-planar portions and any planar portions. Likewise, in an example embodiment, only one side of the work piece is polished by: using a single side polisher, blocking the flat work piece side, and/or simply using a non polishing surface for the side for which polishing is not desired.

The present disclosure teaches a polishing pad configured to provide even polishing of non-planar work pieces over the whole surface of the work piece. This is accomplished without using an excessive force to press the polishing pad towards the work piece. Thus, more complete polishing of the surface may be accomplished. Moreover, the glass blanks are handled less during the polishing process. Thus, the polishing system, methods, and devices disclosed herein facilitate a reduction in parts that wind-up being scrapped as rejected parts or that are broken (from excessive handling or excessive force of the pad).

Nonetheless, the polishing pad can be made of a firm enough material to have relatively fast polishing times. All this can be done without use of brushes or flaps or the like. In an example embodiment, all of the surface (the non-planar and planar portions if any) is polished simultaneously. In another example embodiment, all of the surface is polished during a single polishing step. In contrast to prior methods, here, all of the non-planar surface of the non-planar work piece may be polished without changing the work piece's orientation. Moreover, a single polishing medium (the disclosed polishing pad) can be used to polish the non-planar work piece instead of multiple polishing mediums (e.g., brushes and prior art pads). Including the time to set the work piece pieces into the carrier, the polishing of one group of 10-15 pieces can be done in a total of 10-15 minutes. This is over 4 times faster than prior art polishing systems that take 55-75 minutes to get to the same result. Moreover, there is less time for changing out worn out parts because the polishing, pad has a longer life than the brushes or flaps. In an example embodiment, the polishing pads are less expensive on a total cost per work piece polished basis.

In an example embodiment, the polishing of the planar portion and the non-planar portion is completed without changing the orientation of the work piece (e.g., from vertical to horizontal). In another example embodiment, the polishing of the planar portion and the non-planar portion is completed without interruption. Thus, disclosed herein are improved systems, methods, and devices for polishing work pieces having surfaces that have non-planar portions.

Figure 4:
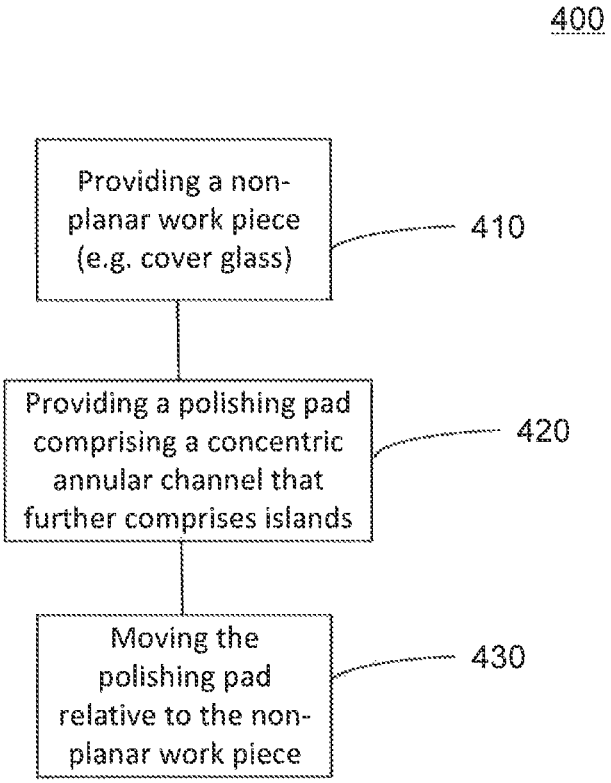
FIG. 4 illustrates an example method for polishing a non-planar work piece, in accordance with various example embodiments.

With reference now to FIG. 4, in an example embodiment, a method 400 of polishing a surface of a non-planar cover glass with a polishing pad comprises: (a) providing the non-planar cover glass (410), the non-planar cover glass comprising a non-planar surface; (b) providing a pad (420)

comprising: (i) a sublayer, wherein the sublayer comprises a concentric annular channel, wherein the concentric annular channel further comprises islands within the concentric annular channel; and (ii) a polishing layer covering the sublayer, wherein the polishing layer is configured to contact and polish the surface of the non-planar cover glass; and (c) moving the pad relative to the non-planar surface (430).

In another example embodiment, a method of polishing a non-planar surface of a work piece is provided, wherein the non-planar surface comprises a planar portion and a non-planar portion. The method comprises: (a) affixing a polishing pad to a planar platen (410 and 420), wherein the polishing pad comprises a concentric annular channel that has a radial width that is less than a length of the work piece, and wherein the polishing pad comprises islands in the concentric annular channel; and (b) moving the polishing pad relative to the work piece to polish both the planar portion and the non-planar portion of the non-planar surface of the work piece (430).

The detailed description of exemplary embodiments of the invention herein shows various exemplary embodiments and the best modes, known to the inventors at this time, of the invention are disclosed. These exemplary embodiment and modes are described in sufficient detail to enable those skilled in the art to practice the invention and are not intended to limit the scope, applicability, or configuration of the invention in any way. Rather, the following disclosure is intended to teach both the implementation of the exemplary embodiments and modes and any equivalent modes or embodiments that are known or obvious to those of reasonably skill in the art. Additionally, all included figures are non-limiting illustrations of the exemplary embodiments and modes, which similarly avail themselves to any equivalent modes or embodiments that are known or obvious to those of reasonable skill in the art.

Other combinations and/or modifications of structures, arrangements, applications, proportions, elements, materials, or components used in the practice of the instant invention, in addition to those not specifically recited, can be varied or otherwise particularly adapted to specific environments, manufacturing specifications, design parameters, or other operating requirements without departing from the scope of the instant invention and are intended to be included in this disclosure.

Unless specifically noted, it is the Applicant's intent that the words and phrases in the specification and the claims be given the commonly accepted generic meaning or an ordinary and accustomed meaning used by those of ordinary skill in the applicable arts, in the instance where these meanings differ, the words and phrases in the specification and the claims should be given the broadest possible, generic meaning. The words and phrases in the specification and the claims should be given the broadest possible meaning. If any other special meaning is intended for any word or phrase, the specification will clearly state and define the special meaning.

While the principles of this disclosure have been shown in various embodiments, many modifications of structure, arrangements, proportions, the elements, materials and components, used in practice, which are particularly adapted for a specific environment and operating requirements may be used without departing from the principles and scope of this disclosure. These and other changes or modifications are intended to be included within the scope of the present disclosure and may be expressed in the following claims.

The present disclosure has been described with reference to various embodiments. However, one of ordinary skill in the art appreciates that various modifications and changes can be made without departing from the scope of the present disclosure. Accordingly, the specification is to be regarded in an illustrative rather than a restrictive sense, and all such modifications are intended to be included within the scope of the present disclosure benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element of any or all the claims.

As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled," "coupling," or any other variation thereof, are intended to cover a physical connection, an electrical connection, a magnetic connection, an optical connection, a communicative connection, a functional connection, and/or any other connection. When language similar to "at least one of A, B, or C" is used in the claims, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

It will be appreciated that the claims presented herein are in single dependency format typical of US Patent Office requirements. Nonetheless, for the avoidance of doubt and for the purposes of filing applications outside the United States it should be understood that where a claim is expressed as being dependent on one claim it should be taking as being dependent on all intervening claims.

Statements

Statement 1. A polishing pad for polishing of a work piece comprising surface portions that are non-planar, the polishing pad configured for use with a flat platen of a polishing machine, the polishing pad comprising:

a first side and a second side of the polishing pad, wherein the second side is opposite the first side, and wherein the second side is configured to polish the work piece;

a concentric annular channel in the polishing pad, wherein the concentric annular channel comprises a channel surface, wherein the second side of the polishing pad comprises an inner surface, the channel surface, and an outer surface, and wherein the channel surface is recessed relative to the inner surface and the outer surface; and a plurality of islands located within the concentric annular channel, wherein each of the plurality of islands comprises an island surface that is raised relative to the channel surface.

Statement 2. The polishing pad of statement 1, wherein the first side is substantially flat and configured to be attached to the flat platen for carrying the polishing pad.

Statement 3. The polishing pad of statement 2, wherein the polishing pad comprises a foam pad.

Statement 4. The polishing pad of statement 2, wherein the polishing pad comprises one of: an embossed pad, a thermoforming made pad, and a stamped pad.

Statement 5. The polishing pad of statement 2, wherein the polishing pad comprises a first foam sub-layer that is laminated on a second foam sub-layer, wherein the concentric annular channel is formed in the second foam sub-layer, and wherein a foam polishing layer is laminated over the first and second foam sub-layers.

Statement 6. The polishing pad of statement 2, wherein the channel surface is recessed a distance approximately equivalent to a part height of the work piece.

Statement 7. The polishing pad of statement 2, wherein the polishing pad comprises: an inner portion located between an inside diameter (ID) of the polishing pad and an ID of the concentric annular channel; a channel portion defined by the concentric annular channel; and an outer portion located between an outside diameter (OD) of the concentric annular channel and an OD of the polishing pad.

Statement 8. The polishing pad of statement 2, wherein the inner surface and the outer surface are co-planar.

Statement 9. The polishing pad of statement 2, wherein the island surface is approximately coplanar with the inner and outer surfaces.

Statement 10. The polishing pad of statement 2, wherein the island surface is recessed relative to the inner and outer surfaces and elevated relative to the channel surface.

Statement 11. The polishing pad of statement 7, wherein at least one of:

a diameter of a center of the concentric annular channel is located half way between the OD of the polishing pad (ODpad) and the ID of the polishing pad (IDpad);

the diameter of the center of the concentric annular channel is equal to 0.5*(ODpad+IDpad);

a radial width of the concentric annular channel is related to a length ("PL") of the work piece to be polished;

the OD of the concentric annular channel ("COD") is equal to 0.5*[PDpad+IDpad+(PL*Y)], wherein Y is a first number greater than 0.5 and less than 1; and the ID of the concentric annular channel ("CID") is equal to 0.5*[ODpad+IDpad−(PL*Z)], wherein Z is a second number greater than 0.5 and less than 1.

Statement 12. The polishing pad of statement 7, wherein the plurality of islands are located about a center of the polishing pad, and wherein at least one of:

the plurality of islands are centered within the concentric annular channel;

the plurality of islands are each centered on a radial center of the concentric annular channel;

each of the plurality of islands is spaced apart from a neighboring island by an on-center distance equal to a part width ("PW") of the work piece to be polished; and the plurality of islands each comprise a diameter of 0.8*PW.

Statement 13. The polishing pad of statement 7, wherein the work piece to be polished is a glass work piece, wherein edges of the glass work piece are non-planar.

Statement 14. The polishing pad of statement 2, wherein the polishing pad further comprises a foam sub-layer and a foam polishing layer laminated over the foam sub-layer, wherein the foam polishing layer is on the second side of the polishing pad.

Statement 15. The polishing pad of statement 14, wherein the concentric annular channel is formed in the polishing pad by one of: embossing the foam sub-layer and the foam polishing layer at the same time, and embossing the foam sub-layer prior to laminating the foam polishing layer over the foam sub-layer.

Statement 16. A method of polishing a surface of a non-planar cover glass with a polishing pad comprising:

providing the non-planar cover glass, the non-planar cover glass comprising a non-planar surface;

providing a pad comprising:

(i) a sublayer, wherein the sublayer comprises a concentric annular channel, wherein the concentric annular channel further comprises islands within the concentric annular channel; and (ii) a polishing layer covering the sublayer, wherein the polishing layer is configured to contact and polish the surface of the non-planar cover glass; and moving the pad relative to the non-planar surface.

Statement 17. A method of polishing a non-planar surface of a work piece, wherein the non-planar surface comprises a planar portion and a non-planar portion, the method comprising:

a. affixing a polishing pad to a planar platen, wherein the polishing pad comprises a concentric annular channel that has a radial width that is less than a length of the work piece, and wherein the polishing pad comprises islands in the concentric annular channel; and b. moving the polishing pad relative to the work piece to polish both the planar portion and the non-planar portion of the non-planar surface of the work piece.

Statement 18. The method of statement 17, wherein the planar portion is a first portion of the non-planar surface of the work piece that has a first surface that is planar, and wherein the non-planar portion is a second portion of the non-planar surface of the work piece that has a second surface that is not in the same plane as the first surface.

Statement 19. The method of statement 17, wherein the polishing of both the planar portion and the non-planar portion is completed without removing the work piece from a carrier holding the work piece.

Statement 20. The method of statement 17, wherein the polishing of both the planar portion and the non-planar portion is completed without brushes.

Statement 21. The method of statement claim 17, wherein the polishing of both the planar portion and the non-planar portion is completed with only a single polishing medium.

Statement 22. The method of statement 17, wherein the polishing of both the planar portion and the non-planar portion is completed all at the same time.

Statement 23. The method of statement 17, wherein the work piece comprises N sides, wherein N is greater than 2, and wherein the polishing of the planar portion and the non-planar portion is completed in a single step.

Statement 24. The method of statement 23, further comprising additional polishing steps, for a total of X polishing steps, wherein each of the X polishing steps involves a different polishing pad for a total of X different polishing pads, wherein a total number of polishing steps for the work piece comprising N sides is X.

Statement 25. The method of statement 17, wherein the polishing pad further comprises a foam sub-layer and a foam polishing layer laminated over the foam sub-layer.

What is claimed is:

1. A polishing pad for polishing a non-planar cover glass driven by a polishing carrier, the polishing pad comprising:

a first porous microcellular foam layer and a second porous microcellular foam layer, wherein the first and second porous microcellular foam layers each comprise a hardness value of 10 to 30 Shore A, and wherein portions of the second porous microcellular foam layer are laminated on to the first porous microcellular foam layer;

an annular channel with an inside diameter and an outside diameter that are concentric about an axis of rotation of the polishing pad, the annular channel formed in the second porous microcellular foam layer, the annular channel having a channel surface that is recessed relative to other portions of the surface of a topside of the second porous microcellular foam layer;

a plurality of islands of microcellular foam located within the annular channel, the islands separate from one another, from the inside diameter, and from the outside diameter, and wherein each of the plurality of islands comprise an island surface that is raised relative to the channel surface; and a polyurethane foam polishing layer, wherein the polyurethane foam polishing layer is laminated over the first and second porous microcellular foam layers, the annular channel and the islands of microcellular foam, wherein the polyurethane foam polishing layer is configured to contact the non-planar cover glass to be polished, wherein the polyurethane foam polishing layer conforms to the channel surface and creates a channel that provides surface contact with a non-planar portion of the non-planar cover glass.

2. The polishing pad of claim 1, where the polyurethane foam polishing layer has a density of 0.3 to 0.8 g/cm3 and a hardness of 65 to 95 ASTM D2240 Shore A.

3. The polishing pad of claim 1, where the porous polyurethane foam layer has a thickness of 0.5 to 1.5 mm.

4. The polishing pad of claim 1, where the porous polyurethane foam layer is grooved in a square pattern, concentric pattern, spiral pattern, or un-grooved.

5. The polishing pad of claim 1, where porous foam sub-layer has a bulk density of 0.005 to 0.015 g/cm3 and a hardness of 5 to 30 ASTM D2240 Shore A.

6. The polishing pad of claim 1, where the annular channel has a depth that is 50 to 100% of the non-planar cover glass thickness.

7. The polishing pad of claim 1, where the annular channel has a width equivalent to the non-planar cover glass length.

8. The polishing pad of claim 1, where the outside diameter of the annular channel is given by the formula: 0.5*(Pad Outside diameter+Pad Inside Diameter)+Part Length.

9. The polishing pad of claim 1, where the inside diameter of the annular channel is given by: 0.5*(Pad Outside Diameter+Pad Inside Diameter)−Part Length.

10. A polishing pad comprising:

a first porous microcellular foam layer;

a second microporous foam layer laminated with pressure sensitive adhesive on both sides, wherein the second microporous foam layer is laminated to the first microporous foam layer, wherein the second microporous foam layer comprises an annular channel with an inside diameter and an outside diameter that are concentric about an axis of rotation of the polishing pad, and wherein the annular channel comprises a channel surface;

a plurality of islands located within the annular channel, wherein each of the plurality of islands are separate from one another, from the inside diameter, and from the outside diameter, wherein each of the plurality of islands comprise an island surface that is raised relative to the channel surface; and a polyurethane foam polishing sheet that is laminated over the first and second microporous foam layers and over the plurality of islands and conforms to the channel surface and the island surface of each of the plurality of islands.

11. The polishing pad of claim 10, wherein said polyurethane foam polishing sheet is formed by mixing a prepolymer, a curing agent, a surfactant, a foaming agent, and an bulk density abrasive filler.

12. The polishing pad of claim 10, wherein said the first and second microporous foam layers and consist of a closed cell microporous polyethylene foam.

13. A polishing pad for polishing of a substrate having portions that are non-planar, the polishing pad configured for use with a platen of a polishing machine, the polishing pad comprising:

a first side and a second side of the polishing pad, wherein the first side is substantially flat and configured to be attached to the platen for carrying the polishing pad, and wherein the second side is configured to polish the substrate having portions that are non-planar;

an annular channel in the polishing pad, wherein the annular channel has an inside diameter and an outside diameter that are concentric about an axis of rotation of the polishing pad, wherein the annular channel comprises a channel surface, wherein the second side of the polishing pad comprises an inner surface, the channel surface, and an outer surface, and wherein the channel surface is recessed relative to the inner surface and outer surface; and a plurality of islands located within the annular channel, wherein each of the plurality of islands comprises an island surface that is raised relative to the channel surface, wherein the island surface is recessed relative to the inner and outer surfaces, wherein each of the plurality of islands are separate from one another, and wherein the island surface for each of the plurality of islands is separate from the inner surface, and from the outer surface.

14. The polishing pad of claim 13, wherein the polishing pad comprises a first porous microcellular foam layer that is laminated on a second porous microcellular foam layer, wherein the annular channel is formed in the second porous microcellular foam layer, and wherein a polyurethane polishing layer is laminated over the first and second porous microcellular foam layers.

15. The polishing pad of claim 13, wherein the channel surface is recessed a distance approximately equivalent to the height of the substrate to be polished.

16. The polishing pad of claim 13, wherein the polishing pad comprises: an inner portion located between an inside diameter (ID) of the polishing pad and the inside diameter of the annular channel; a channel portion defined by the annular channel; and an outer portion located between the outside diameter (OD) of the channel and an OD of the polishing pad.

17. The polishing pad of claim 13, wherein the inner surface and the outer surface are co-planar.

18. The polishing pad of claim 16, wherein a diameter of a center of the annular channel is located half way between the OD of the polishing pad (ODpad) and the ID of the polishing pad (IDpad), wherein the diameter of the center of the annular channel is equal to 0.5*(ODpad+IDpad), wherein a radial width of the annular channel is related to a length ("PL") of the substrate to be polished, wherein the OD of the annular channel ("COD") is equal to 0.5*(ODpad+IDpad)+PL, wherein the ID of the annular channel ("CID") is equal to 0.5*(OD+ID)−PL, wherein the islands are located about the center of the polishing pad, wherein the islands are centered within the annular channel, wherein the islands are each centered on the radial center of the annular channel, wherein each island is spaced apart from a neighboring island by an on-center distance equal to a part width ("PW") of the substrate to be polished, wherein the islands each comprise a diameter of 0.8*PW.

19. The polishing pad of claim 13, wherein the substrate to be polished is a glass substrate.

20. The polishing pad of claim 19, wherein the glass substrate comprises portions of the glass substrate that are non-planar.

21. The polishing pad of claim 20, wherein the edges of the glass substrate are non-planar.

* * * * *